US008988334B2

(12) United States Patent
Ge et al.

(10) Patent No.: US 8,988,334 B2
(45) Date of Patent: Mar. 24, 2015

(54) COLUMN INVERSION TECHNIQUES FOR IMPROVED TRANSMITTANCE

(75) Inventors: Zhibing Ge, Sunnyvale, CA (US); Yongman Lee, Pleasanton, CA (US); Shih Chang Chang, Cupertino, CA (US); Cheng Chen, Cupertino, CA (US); Hopil Bae, Sunnyvale, CA (US); Ming Xu, Cupertino, CA (US); Shawn Robert Gettemy, San Jose, CA (US); Wei H. Yao, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 598 days.

(21) Appl. No.: 12/941,751

(22) Filed: Nov. 8, 2010

(65) Prior Publication Data

US 2012/0113154 A1 May 10, 2012

(51) Int. Cl.
*G09G 3/36* (2006.01)

(52) U.S. Cl.
CPC ..... *G09G 3/3614* (2013.01); *G09G 3/3648* (2013.01); *G09G 2320/0209* (2013.01); *G09G 2330/021* (2013.01)
USPC ..... 345/96

(58) Field of Classification Search
USPC ..... 345/96
See application file for complete search history.

(56) References Cited

U.S. PATENT DOCUMENTS

| | | | | |
|---|---|---|---|---|
| 5,006,840 | A * | 4/1991 | Hamada et al. | 345/88 |
| 6,160,535 | A * | 12/2000 | Park | 345/88 |
| 6,496,172 | B1 | 12/2002 | Hirakata | |
| 6,683,592 | B1 * | 1/2004 | Murade | 345/87 |
| 6,982,692 | B2 * | 1/2006 | Kim | 345/96 |
| 7,233,377 | B2 | 6/2007 | Liao et al. | |
| 7,268,764 | B2 * | 9/2007 | Song et al. | 345/100 |
| 7,548,288 | B2 * | 6/2009 | Kim et al. | 349/84 |
| 7,548,295 | B2 * | 6/2009 | Kawasaki et al. | 349/141 |
| 8,139,037 | B2 * | 3/2012 | Furuhashi et al. | 345/173 |
| 2001/0038370 | A1 * | 11/2001 | Yeung | 345/87 |
| 2002/0063807 | A1 * | 5/2002 | Margulis | 348/745 |
| 2007/0126934 | A1 * | 6/2007 | Miura et al. | 348/655 |

* cited by examiner

*Primary Examiner* — Kathy Wang-Hurst
*Assistant Examiner* — Joseph Fox
(74) *Attorney, Agent, or Firm* — Fletcher Yoder PC

(57) ABSTRACT

Present techniques involve methods and systems of inversion patterns for pixels in a display. Inversion techniques involve driving image signals having a first polarity to data lines of a pixel matrix during a first time period and driving image signals having an opposite polarity to the data lines during a second time period. In some embodiments, the pixels may be configured to have electrodes having only two finger electrodes, thus widening the distance between electrodes and decreasing the susceptibility for crosstalk between pixels. In some embodiments, horizontal cross-talk of electromagnetic fields between pixels may be further reduced by configuring the data line driving scheme such that voltage polarity is flipped for the pixels along every two, three, or more data line columns. Furthermore, a Z inversion pattern may be employed to reduce the occurrence of undesirable display artifacts.

20 Claims, 11 Drawing Sheets

COLUMN INVERSION TECHNIQUES FOR IMPROVED TRANSMITTANCE

BACKGROUND

The present disclosure relates generally to control of a display device.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Liquid crystal displays (LCDs) are commonly used as screens or displays for a wide variety of electronic devices, including such consumer electronics as televisions, computers, and handheld devices (e.g., cellular telephones, audio and video players, gaming systems, and so forth). Such LCD devices typically provide a flat display in a relatively thin package that is suitable for use in a variety of electronic goods. In addition, such LCD devices typically use less power than comparable display technologies, making them suitable for use in battery-powered devices or in other contexts where it is desirable to minimize power usage.

LCDs typically include an LCD panel having, among other things, a liquid crystal layer and various circuitry for controlling orientation of liquid crystals within the layer to modulate an amount of light passing through the LCD panel and thereby render images on the panel. If a voltage of a single polarity is consistently applied to the liquid crystal layer, a biasing (polarization) of the liquid crystal layer may occur such that the light transmission characteristics of the liquid crystal layer may be disadvantageously altered.

To aid in preventing this biasing of the liquid crystal layer, periodic inversion of the electric field applied to the liquid crystal layer may be utilized. Furthermore, various inversion techniques may be utilized to reduce visual artifacts caused by slight differences in the value of applied positive and negative voltages during the periodic inversion of the electric field applied to the liquid crystal layer. For example, certain inversion techniques involve driving each adjacent pixel location in the liquid crystal layer to a voltage opposite of its neighboring pixels over a given time frame. While such techniques may generally reduce the appearance of visual artifacts on the LCD, a substantial amount of power may be used to perform such techniques. Furthermore, the driving voltages of opposite polarities between neighboring pixels may result in crosstalk between the neighboring pixels, which may reduce light transmittance through the LCD panel. Accordingly, there is a need for techniques which consume lower power, minimize undesirable visual artifacts, and control and/or limit the reduction of light transmittance through the LCD.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Techniques are provided for driving a matrix of pixels in a display with positive and negative voltages. Data line drivers of a display may drive a first voltage, (e.g., a positive voltage) to a first set of data lines of a pixel array (matrix) in a display during a first period of time in a frame (i.e., the time required to update data for the entire matrix of pixels) and drive a second voltage (e.g., a negative voltage) which is an inverse of the first voltage to the remaining second set of data lines of the pixel array during the first period of time. Data line drivers may subsequently drive the second voltage to the first set of data lines and the first voltage to the second set of data lines during a second period of time in the frame. Therefore, each scanning line row of the pixel array include pixels (or sub-pixels) driven to the first voltage, as well as pixels driven to the second voltage. Some embodiments involve configuring the data line driving scheme such that voltage polarity is inverted for the pixels along every two, three, or more data lines. Furthermore, a Z inversion pattern may be employed such that pixels in the same scanning line rows have a flipped polarity every two pixels while pixels in the same data line columns have a flipped polarity at every pixel. Embodiments include various configurations and combinations of techniques, depending on system requirements and/or the desirability of minimizing power consumption, minimizing undesirable visual artifacts, and maximizing light transmittance.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
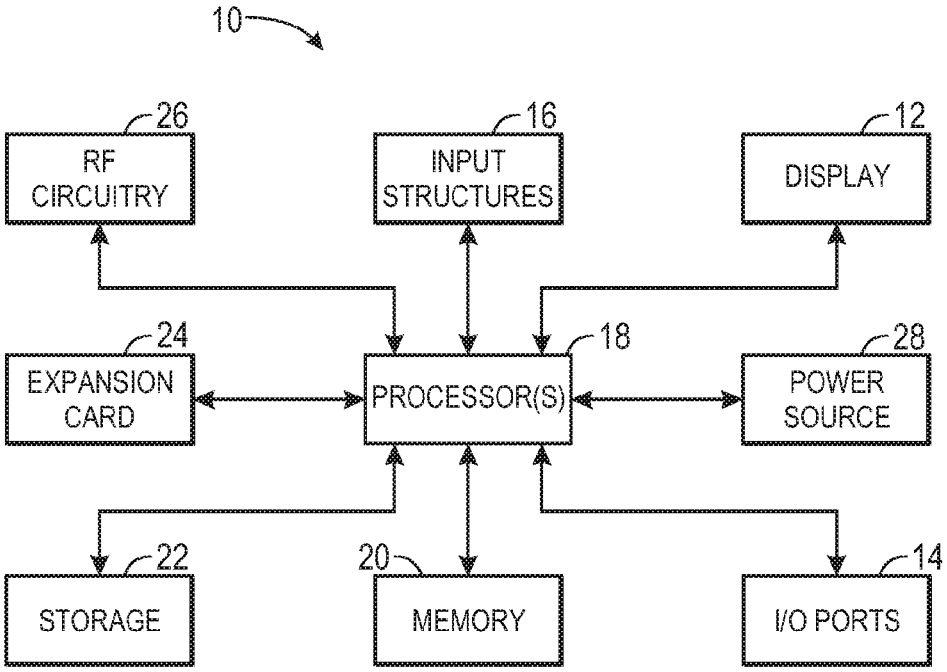
FIG. 1 is a block diagram of an electronic device, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure are generally directed to reducing power consumption, improving light transmission, and reducing visual artifacts in an electronic display, such as an LCD, by driving a matrix of pixels in a display with alternating positive and negative voltages to aid in prevent biasing of the pixels in the display. For example, data line drivers of a display may drive a first voltage, (e.g., a positive voltage) to a first set of data lines of a pixel array (matrix) in a display during a first period of time in a frame (i.e., the time required to update data for the entire matrix of pixels) and drive a second voltage (e.g., a negative voltage) which is an inverse of the first voltage to the remaining second set of data lines of the pixel array during the first period of time. During a second period of time in the frame, data line drivers may drive the second voltage to the first set of data lines and the first voltage to the second set of data lines. Therefore, at any time during the operation of the display, each scanning line row of the pixel array includes pixels (or sub-pixels) driven to the first voltage, as well as pixels driven to the (inverse) second voltage.

One or more embodiments involve configuring the data line driving scheme such that voltage polarity is inverted for the pixels along every two, three, or more data line columns. By inverting the polarity of the driven voltage every two or more data line columns, as opposed to inverting the polarity at every adjacent column, crosstalk between the electrodes of adjacent pixels may be reduced. Furthermore, the pixel matrix and data line connections may be configured to employ a "Z-inversion" technique, such that pixels in the same scanning line rows have a flipped polarity every two pixels while pixels in the same data line columns have a flipped polarity at every pixel. Embodiments include various configurations and combinations of column inversion techniques, depending on system requirements of the LCD, desired system characteristics, and/or an optimization of minimizing power consumption, minimizing undesirable visual artifacts, and maximizing light transmittance through the display area. With these foregoing features in mind, a general description of electronic devices including a display that may use the presently disclosed technique is provided below.

As may be appreciated, electronic devices may include various internal and/or external components which contribute to the function of the device. For instance, FIG. 1 is a block diagram illustrating components that may be present in one such electronic device 10. Those of ordinary skill in the art will appreciate that the various functional blocks shown in FIG. 1 may include hardware elements (including circuitry), software elements (including computer code stored on a computer-readable medium, such as a hard drive or system memory), or a combination of both hardware and software elements. FIG. 1 is only one example of a particular implementation and is merely intended to illustrate the types of components that may be present in the electronic device 10. For example, in the presently illustrated embodiment, these components may include a display 12, input/output (I/O) ports 14, input structures 16, one or more processors 18, one or more memory devices 20, non-volatile storage 22, expansion card(s) 24, networking device 26, and power source 28.

The display 12 may be used to display various images generated by the electronic device 10. The display 12 may be any suitable display, such as a liquid crystal display (LCD) or an organic light-emitting diode (OLED) display. Additionally, in certain embodiments of the electronic device 10, the display 12 may be provided in conjunction with a touch-sensitive element, such as a touchscreen, that may be used as part of the control interface for the device 10. The display 12 may include a matrix of pixels and circuitry for modulating the transmittance of light through each pixel to display an image. In some embodiments, the matrix of pixels may be configured such that column inversion driving schemes may be employed to reduce crosstalk between horizontally adjacent pixels, thereby reducing light transmittance loss.

Figure 2:
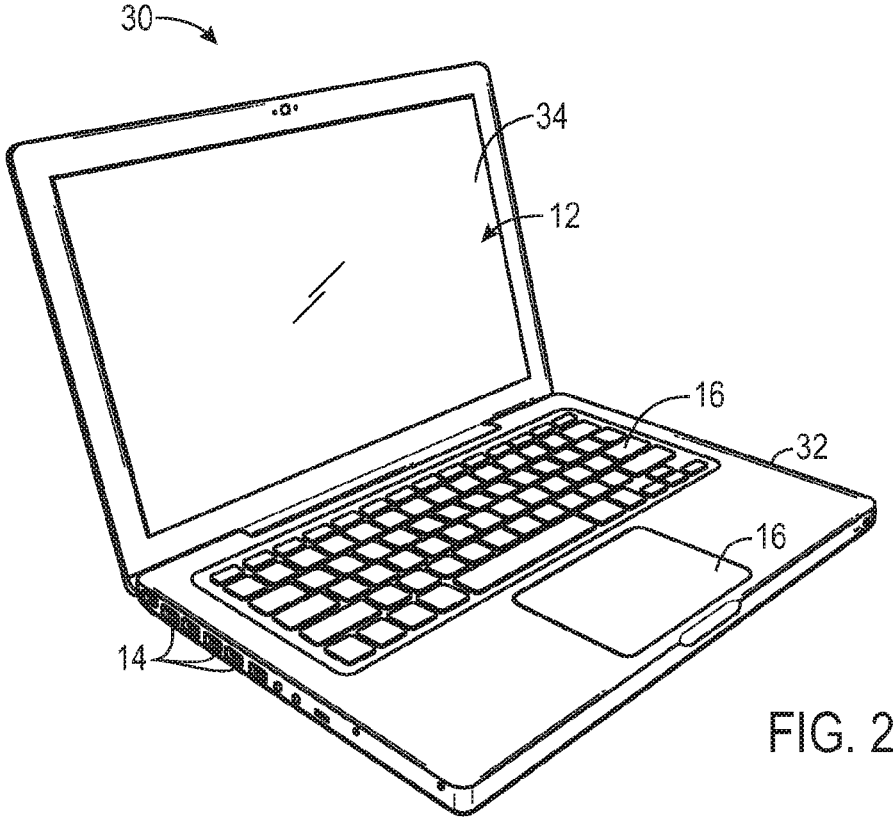
FIG. 2 is a perspective view of a computer in accordance with aspects of the present disclosure.

The electronic device 10 may take the form of a computer system or some other type of electronic device. Such computers may include computers that are generally portable (such as laptop, notebook, tablet, and handheld computers), as well as computers that are generally used in one place (such as conventional desktop computers, workstations and/or servers). In certain embodiments, electronic device 10 in the form of a computer may include a model of a MacBook®, MacBook® Pro, MacBook Air®, iMac®, Mac® mini, or Mac Pro® available from Apple Inc. of Cupertino, Calif. By way of example, an electronic device 10 in the form of a laptop computer 30 is illustrated in FIG. 2 in accordance with one embodiment. The depicted computer 30 includes a housing 32, a display 12 (e.g., in the form of an LCD 34 or some other suitable display), I/O ports 14, and input structures 16.

The display 12 may be integrated with the computer 30 (e.g., such as the display of the depicted laptop computer) or may be a standalone display that interfaces with the computer 30 using one of the I/O ports 14, such as via a DisplayPort, Digital Visual Interface (DVI), High-Definition Multimedia Interface (HDMI), or analog (D-sub) interface. For instance, in certain embodiments, such a standalone display 12 may be a model of an Apple Cinema Display®, available from Apple Inc.

Figure 3:
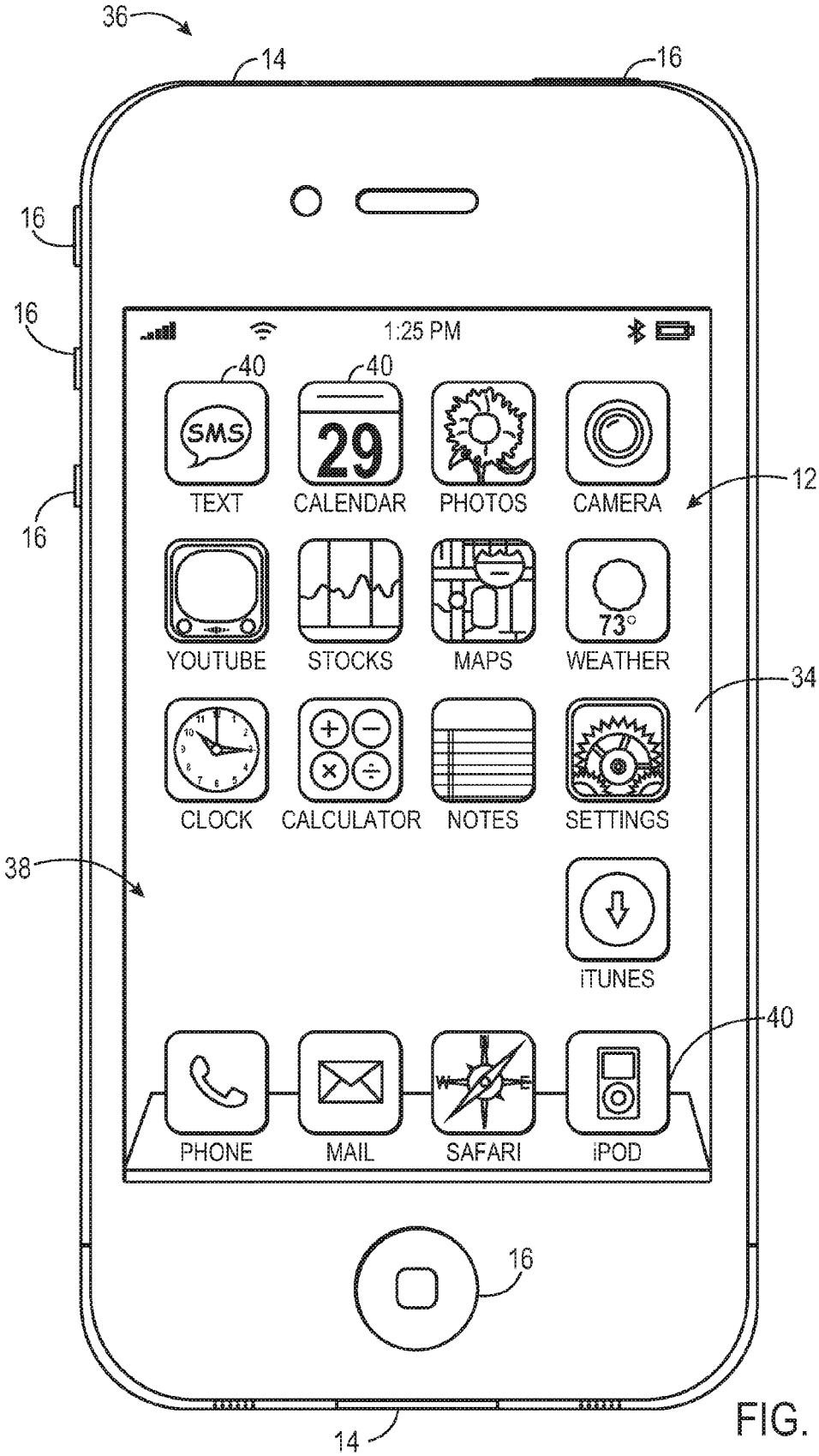
FIG. 3 is a perspective view of a handheld electronic device in accordance with aspects of the present disclosure.

Although an electronic device 10 is generally depicted in the context of a computer in FIG. 2, an electronic device 10 may also take the form of other types of electronic devices. In some embodiments, various electronic devices 10 may include mobile telephones, media players, personal data organizers, handheld game platforms, cameras, and combinations of such devices. For instance, as generally depicted in FIG. 3, the device 10 may be provided in the form of handheld electronic device 36 that includes various functionalities (such as the ability to take pictures, make telephone calls, access the Internet, communicate via email, record audio and video, listen to music, play games, and connect to wireless networks). By way of further example, handheld device 36 may be a model of an iPod®, iPod® Touch, or iPhone® available from Apple Inc. In the depicted embodiment, the handheld device 32 includes the display 12, which may be in the form of an LCD 34. The LCD 34 may display various images generated by the handheld device 32, such as a graphical user interface (GUI) 38 having one or more icons 40.

In another embodiment, the electronic device 10 may also be provided in the form of a portable multi-function tablet computing device (not illustrated). In certain embodiments, the tablet computing device may provide the functionality of two or more of a media player, a web browser, a cellular phone, a gaming platform, a personal data organizer, and so forth. By way of example only, the tablet computing device may be a model of an iPad® tablet computer, available from Apple Inc.

With the foregoing discussion in mind, it may be appreciated that an electronic device 10 in either the form of a handheld device 30 (FIG. 2) or a computer 50 (FIG. 3) may be provided with a display device 10 in the form of an LCD 34. As discussed above, an LCD 34 may be utilized for displayed respective operating system and/or application graphical user interfaces running on the electronic device 10 and/or for displaying various data files, including textual, image, video data, or any other type of visual output data that may be associated with the operation of the electronic device 10.

Figure 4:
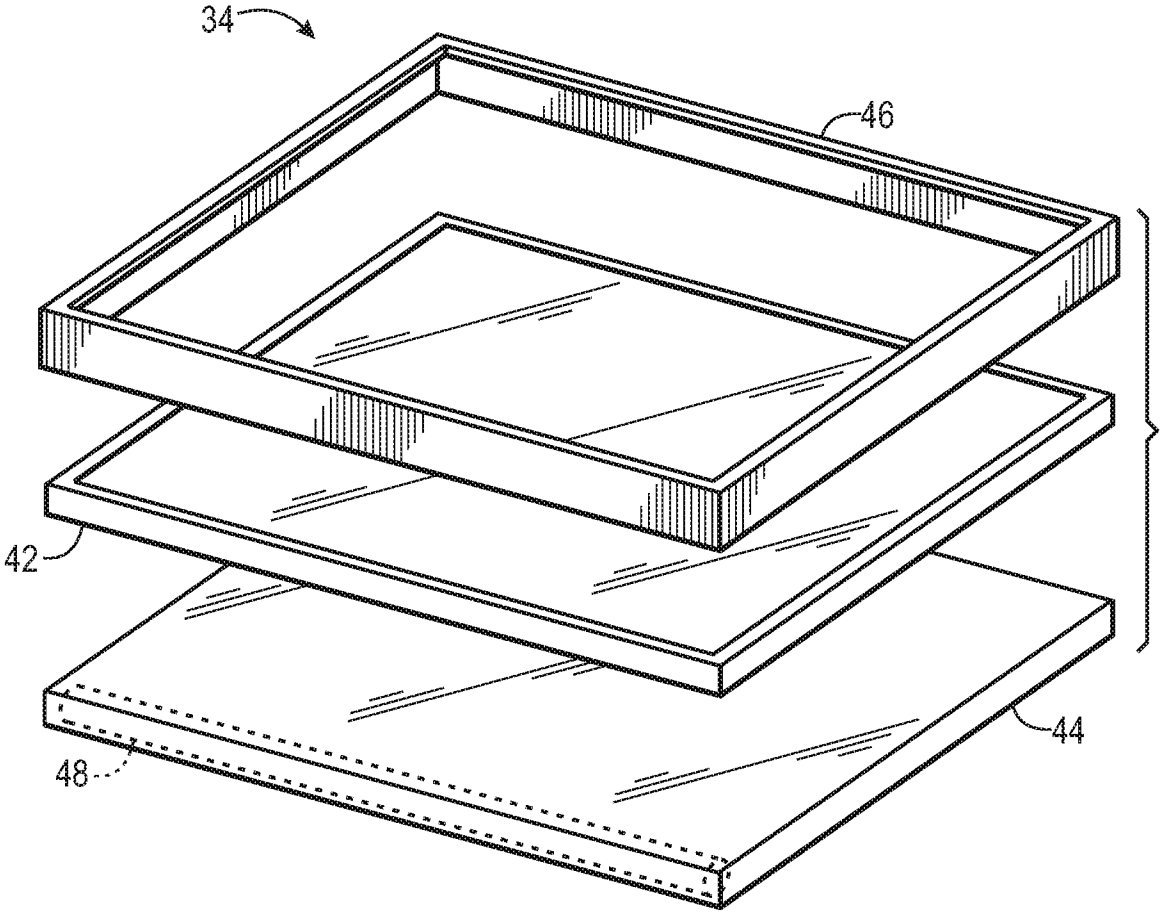
FIG. 4 is an exploded view of a liquid crystal display (LCD) in accordance with aspects of the present disclosure.

One example of an LCD display 34 is depicted in FIG. 4 in accordance with one embodiment. The depicted LCD display 34 includes an LCD panel 42 and a backlight unit 44, which may be assembled within a frame 46. As may be appreciated, the LCD panel 42 may include an array of pixels configured to selectively modulate the amount and color of light passing from the backlight unit 44 through the LCD panel 42. For example, the LCD panel 42 may include a liquid crystal layer, one or more thin film transistor (TFT) layers configured to control orientation of liquid crystals of the liquid crystal layer via an electric field, and polarizing films, which cooperate to enable the LCD panel 42 to control the amount of light emitted by each pixel. Additionally, the LCD panel 42 may include color filters that allow specific colors of light to be emitted from the pixels (e.g., red, green, and blue).

The backlight unit 44 includes one or more light sources 48. Light from the light source 48 is routed through portions of the backlight unit 44 (e.g., a light guide and optical films) and generally emitted toward the LCD panel 42. In various embodiments, light source 48 may include a cold-cathode fluorescent lamp (CCFL), one or more light emitting diodes (LEDs), or any other suitable source(s) of light. Further, although the LCD 34 is generally depicted as having an edge-lit backlight unit 44, it is noted that other arrangements may be used (e.g., direct backlighting) in full accordance with the present technique.

Figure 5:
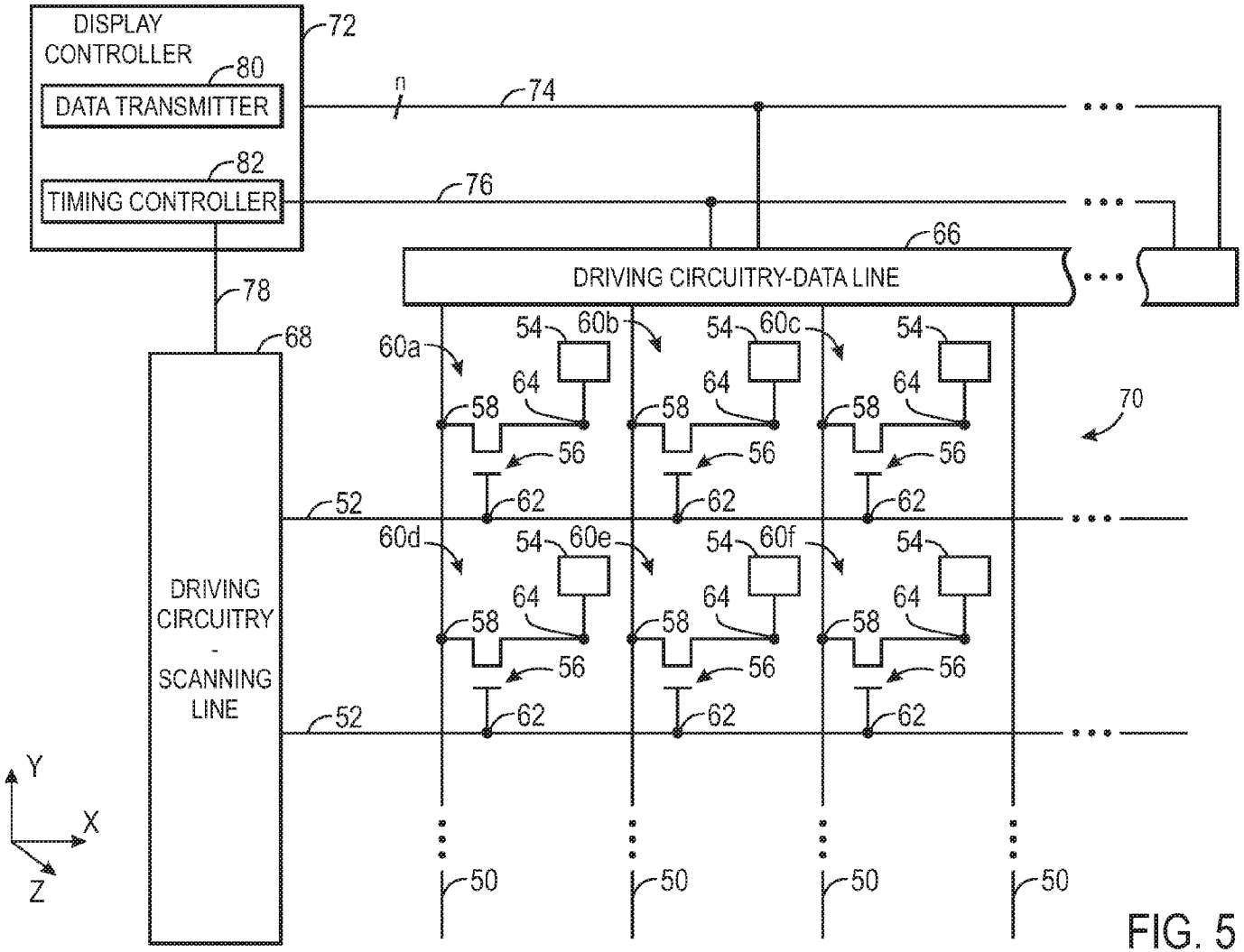
FIG. 5 graphically depicts circuitry that may be found in the LCD of FIG. 4 in accordance with aspects of the present disclosure.

Referring now to FIG. 5, an example of a circuit view of pixel-driving circuitry found in an LCD 34 is provided. For example, the circuitry depicted in FIG. 5 may be embodied on the LCD panel 42 described above with respect to FIG. 4. The pixel-driving circuitry includes an array or matrix 70 of unit pixels 60 that are driven by data (or source) line driving circuitry 66 and scanning (or gate) line driving circuitry 68. Data and clock signals may be transmitted to the data line driving circuitry 66 and the scanning line driving circuitry 68 by a display controller 72. As depicted, the matrix 70 of unit pixels 60 (represented by pixels 60*a*-60*f* in this illustration) forms an image display region of the LCD 34. In such a matrix, each unit pixel 60 may be defined by the intersection of data lines 50 and scanning lines 52, which may also be referred to as source lines 50 and gate lines 52. The data line driving circuitry 66 may include one or more driver integrated circuits (also referred to as column drivers) for driving the data lines 50. The scanning line driving circuitry 68 may also include one or more driver integrated circuits (also referred to as row drivers). By way of example, in a color LCD panel 34 having a display resolution of 960×640, each of the 960 data lines 50 (defining a column of the pixel array in some embodiments) may include 640 unit pixels, while each of the 640 scanning lines 52, (defining a row in some embodiments) may include 960 groups of pixels. For example, some embodiments of the LCD panel 34 may be a model of the Retina™ display, available from Apple Inc.

Each unit pixel 60 includes a pixel electrode 54 and thin film transistor (TFT) 56 for switching the pixel electrode 54. In the depicted embodiment, the source 58 of each TFT 56 is electrically connected to a data line 50, extending from respective data line driving circuitry 66. Similarly, in the depicted embodiment, the gate 62 of each TFT 56 is electrically connected to a scanning or gate line 52, extending from respective scanning line driving circuitry 68. In one embodiment, column drivers of the data line driving circuitry 66 may send image signals to the pixels 60 by way of the respective data lines 50, and the scanning lines 52 may apply scanning signals from the scanning line driving circuitry 68 to the respective gates 62 of each TFT 56 to which the respective scanning lines 52 are connected. Such scanning signals may be applied by line-sequence with a predetermined timing or in a pulsed manner.

Each TFT 56 serves as a switching element which may be activated and deactivated (i.e., turned on and off) for a predetermined period based on the respective presence or absence of a scanning signal at its gate 62. When activated, a TFT 56 may store the image signals received via a respective data line 50 as a charge in the pixel electrode 54 with a predetermined timing.

The image signals, also referred to as data signals or voltage signals, may be stored at the pixel electrode 54 and used to generate an electrical field between the respective pixel electrode 54 and a common electrode. Such an electrical field may align liquid crystals within a liquid crystal layer to modulate light transmission through the LCD panel 42. In some embodiments, each unit pixel electrode 54 may include a number of "finger" electrodes, i.e. strips of electrode plates which are electrically connected as a unit pixel 60. For example, a unit pixel 60 may have one or multiple parallel finger electrodes, and in other embodiments, other configurations may be possible.

Unit pixels 60 may operate in conjunction with various color filters, such as red, green, and blue filters. In such embodiments, a "pixel" of the display may actually include multiple unit pixels, such as a red unit pixel (e.g., 60*a*), a green unit pixel (e.g., 60*b*), and a blue unit pixel (e.g., 60*c*), each of which may be modulated to increase or decrease the amount of light emitted to enable the display to render numerous colors via additive mixing of the colors. In some embodiments, a storage capacitor may also be provided in parallel to the liquid crystal capacitor formed between the pixel electrode 54 and the common electrode to prevent leakage of the stored image signal at the pixel electrode 54. For example, such a storage capacitor may be provided between the drain 64 of the respective TFT 56 and a separate capacitor line.

In some embodiments, the transmission of image data may be controlled by the display controller 72. Data signals and clock signals may be generated by the display controller 72 and transmitted to the data line driving circuitry 66 and the scanning line driving circuitry 68 via a data line 74 and clock lines 76 and 78. Specifically, the data signals may be transmitted by a data transmitter 80 in the display controller 72 and may generally includes image data to be processed by data line driving circuitry 66 of the LCD 34 to drive the pixels 60 and render an image on the LCD 34. A timing controller 82 in the display controller 72 may send signals to clock one or more data line drivers in the data line driving circuitry 66 and one or more scanning line drivers in the scanning line driving circuitry 68. Thus, the data line driving circuitry 66 may sequentially drive voltage signals to each data line 50 of the pixel array 70 to render an image on the LCD 34.

Consistently driving voltage signals of a single polarity to the pixels 60 may result in a biasing (polarization) of the liquid crystal layer in the pixels 60, such that the light transmission characteristics of the liquid crystal layer may be disadvantageously altered. For example, biasing the liquid crystal layer of the pixels 30 may result in a reduced light transmission through the LCD panel 42, thus disadvantageously altering the image produced on the LCD 34. To aid in preventing biasing of the liquid crystal layer of the LCD panel 42, periodic inversion of the electric field applied to the liquid crystal layer may be utilized. However, inverting the polarity of an entire pixel matrix 70 (or inverting the polarity of a perceptible portion of the pixel matrix 70) from one polarity to the inverse polarity may result in undesirable visual effects such as flickering. As such, column inversion techniques may be employed, such that the polarities of adjacent pixel columns may be inverse, thus canceling out and/or reducing possible undesirable visual effects resulting from polarity inversion of a large pixel matrix 70 area.

Figure 6:
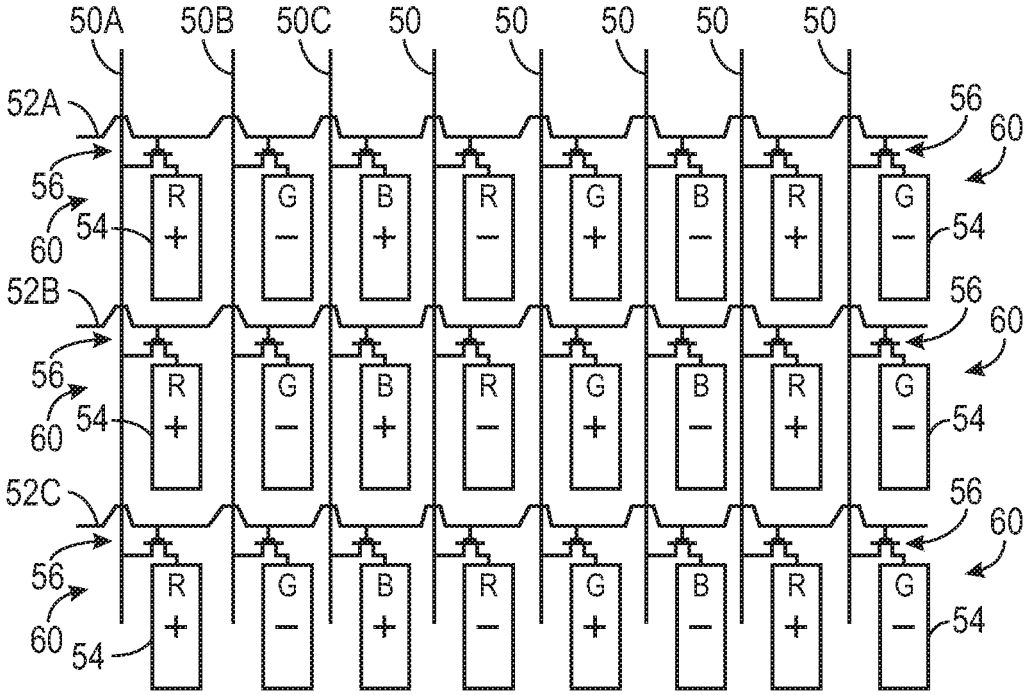
FIG. 6 is a diagram of a column inversion scheme in a LCD.

FIG. 6 illustrates one example of a typical column inversion scheme, where the voltage signal driven to the pixels 60 of one data line 50*a* has an inverse polarity from the voltage signal driven to the pixels 60 of its adjacent data line 50*b*. Each pixel column in the pixel matrix may be an opposite polarity from its adjacent pixel column, as indicated by the alternating positive and negative signs marked in the pixel electrodes 54 connected along each data line 50. Thus, while the pixels 60 along one data line 50 may be driven with a voltage signal of the same polarity, the pixels 60 along one gate line 52 may have pixels driven with voltages of alternating polarities. However, due to the close proximity of pixels 60 along the gate line 52 direction, the pixel electrodes 54 may be affected by horizontal field crosstalk. Horizontal field crosstalk may refer to coupling, interference, or other undesirable effects resulting from the proximity of pixels 60 along the direction of the gate lines 52, and may simply be referred to as crosstalk.

Figure 7:
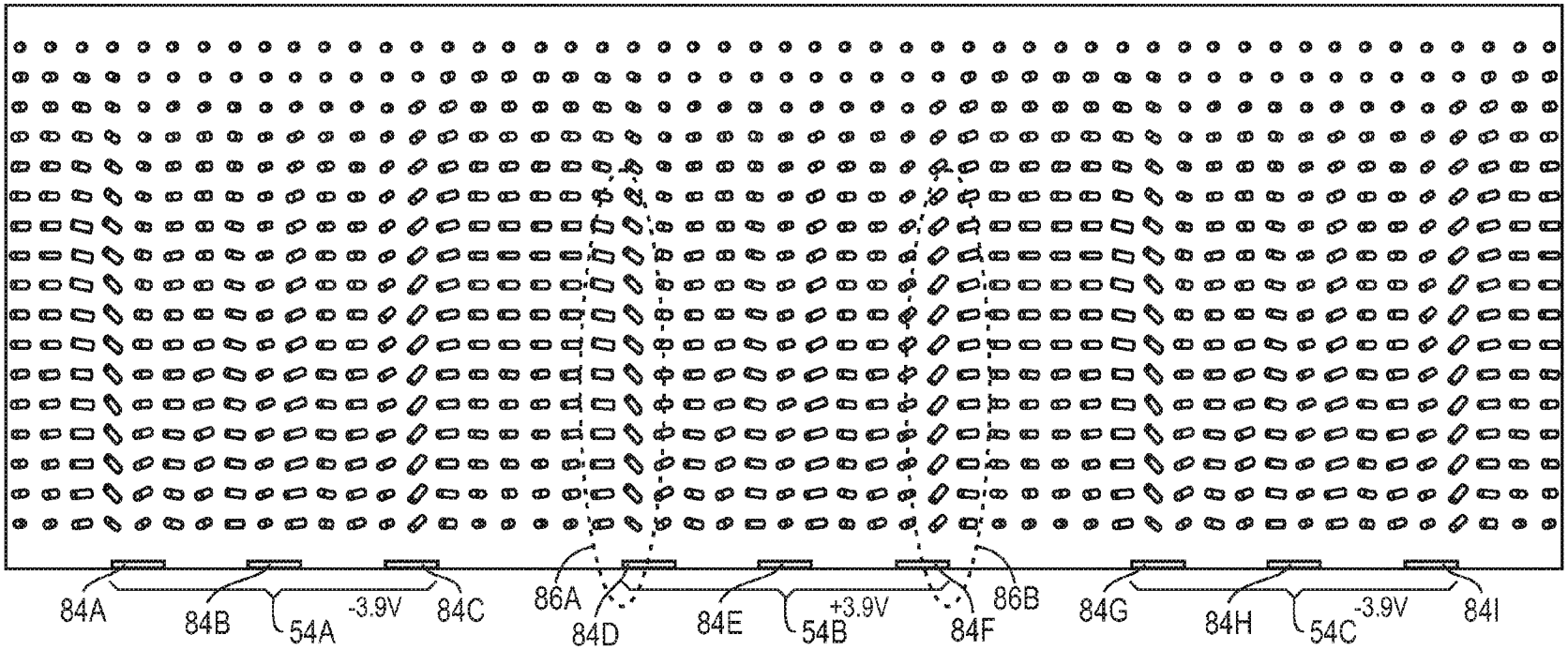
FIG. 7 is a diagram representing an affect of crosstalk on the liquid crystals of adjacent pixel electrodes.

A diagram representing the effects of horizontal field crosstalk is provided in FIG. 7. The diagram of FIG. 7 represents axial cross sections of three adjacent pixel electrodes 54, each with three finger electrodes 84. A typical column inversion scheme may be applied, as indicated by the −3.9V signal driven to pixel electrode 54*a*, the +3.9V signal driven to pixel electrode 54*b*, and the −3.9V signal driven to pixel electrode 54*c*. As discussed, image signals may be driven to pixels 60 via data lines 50, and the TFT 56 in each pixel 60 may store a charge in the pixel electrode 54, which generates an electrical field. The electrical field may align liquid crystals within a liquid crystal layer of the pixel 60 to modulate light transmission through the LCD panel 42. In FIG. 7, the rods illustrated over each pixel electrode 54 represent the alignment and/or orientation of liquid crystals based on the electrical fields generated by pixel electrodes 54*a*, 54*b*, and 54*c*.

The close proximity of pixels 60 within the LCD panel 42 may cause the liquid crystal orientations of one pixel electrode 54*b* to be affected by the inversely driven adjacent pixel electrode 54*a*. For instance, while a positive voltage signal may be driven to pixel electrode 54*b* to align the liquid crystals in a particular orientation, a negative voltage signal may align the liquid crystals of the pixel electrode 54*a* in an inverse orientation, which may result in a coupling effect between the liquid crystals in the two pixel electrodes 54*a* and 54*b*. This coupling effect may cause the liquid crystals to be misaligned, or not oriented according to the voltage signal transmitted from the data line 50.

In finger electrode pixel configurations, the crosstalk effect may be greater in the outermost finger electrodes 84 having closer proximity to adjacent pixels 60 and data lines 50, and thus outermost finger electrodes 84 of a pixel 60 may exhibit greater susceptibility to crosstalk due to inversely driven adjacent pixels 60. For example, the orientation of liquid crystals aligned by the finger electrode 84*d* (driven with a positive voltage signal) may be affected by the negative voltage signal driving the finger electrode 84*c*. The liquid crystals of the finger electrode 84*d* may be oriented with a higher tilt than what was intended by the voltage signal applied to the pixel electrode 54*b*, as represented by the tilted rods in the dotted circle 86*a*. Similarly, the liquid crystals aligned by the finger electrode 84*f* may be affected by the inverse polarity of the voltage signal driven to the finger electrode 84*g*, as represented by the tilted rods in the dotted circle 86*b*.

Figure 8:
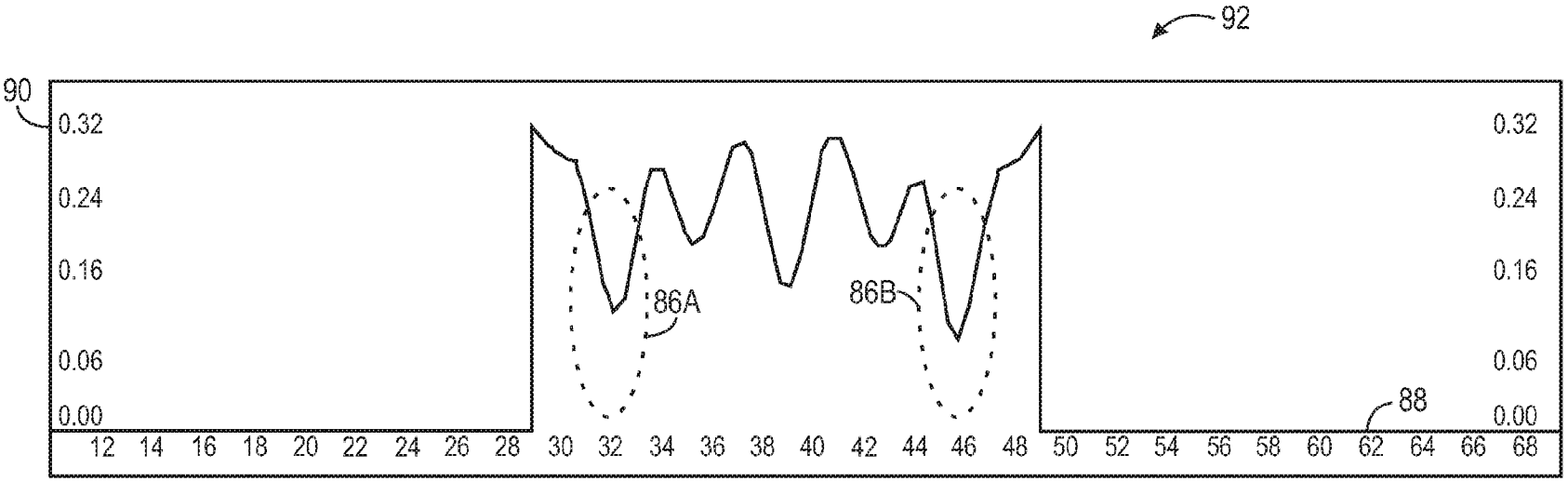
FIG. 8 is a graph representing a reduction in transmittance due to crosstalk between adjacent pixels.

Such misalignments of the liquid crystals in the outer finger electrodes 84 and/or in the outer portions of pixel electrodes 54 may result in a loss of light transmittance through the liquid crystal layer and through the LCD panel 42, as represented in the graph of FIG. 8. FIG. 8 provides a graph 92 estimating the light transmittance 90 over a position 88 of a pixel electrode 54 affected by crosstalk. The two dotted circles 86*a* and 86*b* may correspond to the positions of the misaligned liquid crystals of the affected finger electrodes 84*d* and 84*f*, respectively (FIG. 7). Due to the effects of crosstalk in the outer electrodes 84*d* and 84*f*, light transmittance 90 through the LCD panel 42 may be lower at the dotted circles 86*a* and 86*b* than compared to positions over the pixel electrode 54 not affected by crosstalk (e.g., a position corresponding to a middle finger electrode 84*e*).

Figure 9:
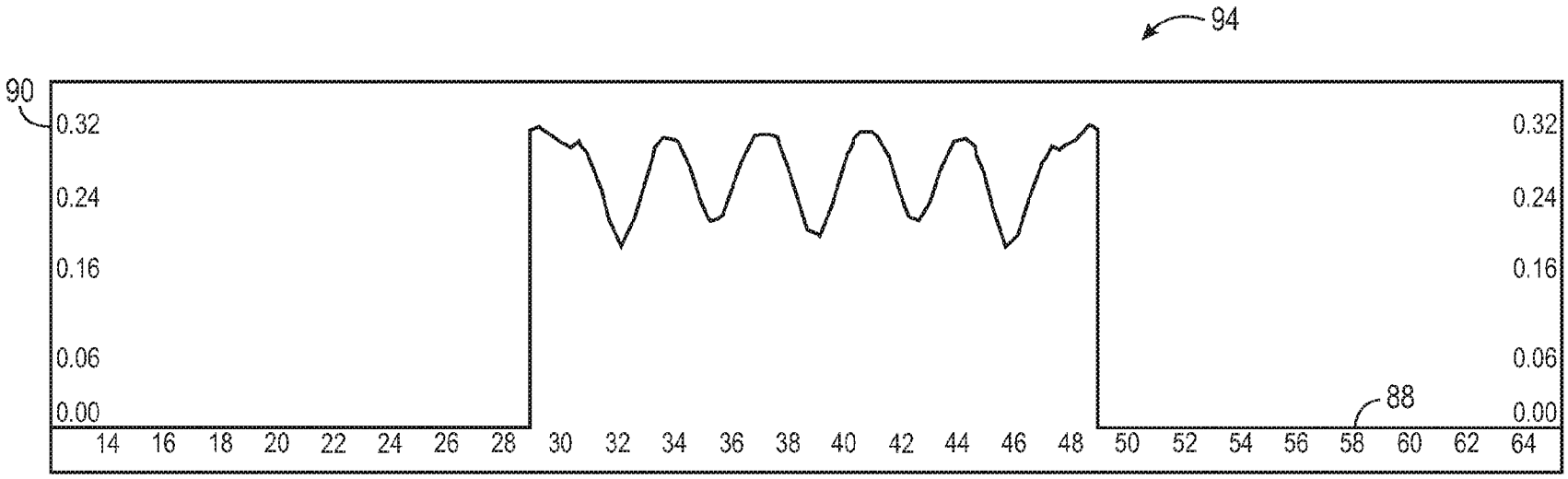
FIG. 9 is a graph representing transmittance with no substantial crosstalk.

Furthermore, the reduction of light transmittance 90 on pixels 60 driven using typical column inversion techniques may also be greater than when typical column inversion techniques are not used, and pixels 60 are driven with voltage signals of the same polarity in the direction of the gate lines 52. For example, FIG. 9 provides a graph 94 estimating light transmittance 90 over a position 88 of a pixel electrode 54 that is not substantially affected by crosstalk. A comparison of the graph 92 of FIG. 8 and the graph 94 of FIG. 9 may indicate that pixels 60 affected by the close proximity of adjacent pixels 60 driven with inverse voltage signals may have reduced light transmittance than pixels 60 having adjacent pixels 60 driven with the same polarity of voltage signals. In some LCD 34 configurations, such a reduction in light transmittance may be approximately 11% or may otherwise be visually perceivable.

In various embodiments, as provided in FIGS. 10-13, techniques are provided for employing column inversion while reducing and/or limiting crosstalk. Certain embodiments provided in FIGS. 10-13 may be implemented by additional and/or modified hardware of LCD 34. Further, some embodiments may be implemented by reprogramming instructions in the display controller 72 (FIG. 5) and/or by reconfiguring circuitry in the data line driving circuitry 66, such that redesigning or addition of hardware components may be unnecessary. Moreover, while the diagrams in FIGS. 10-13 include positive (+) and negative (−) polarity markings in the pixel electrodes 54 of the pixels 60, it should be noted that the polarity markings represent the polarity of an image signal (also referred to as a voltage signal) driven to the pixels 60 during one period of time (e.g., one or more frames or one fraction of a frame). In accordance with one or more embodiments of column inversion techniques, the polarity of image signals driven to each of the pixels 60 may switch in an immediately subsequent period of time.

Figure 10:
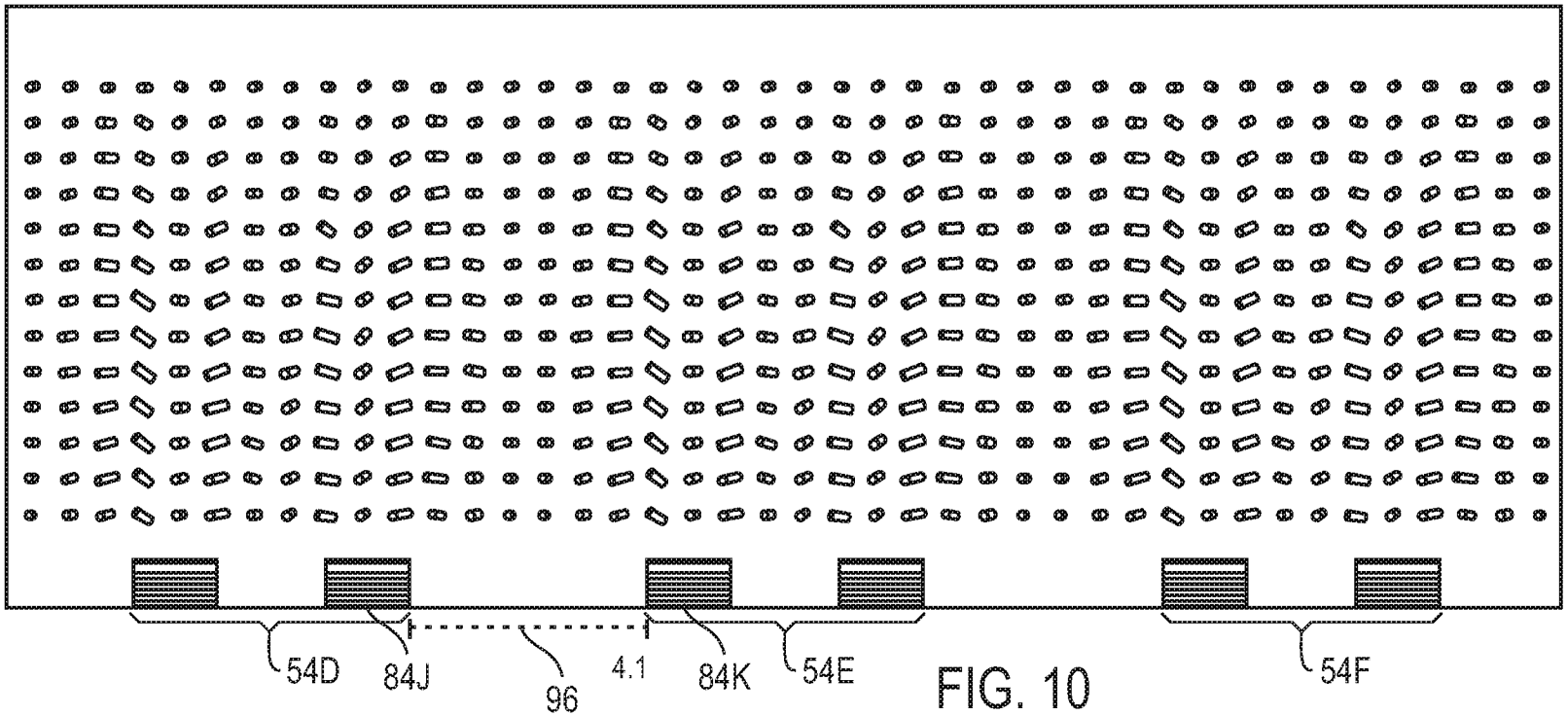
FIG. 10 is a diagram representing improved transmittance in a two-finger electrode pixel configuration, in accordance with aspects of the present disclosure

FIG. 10 provides one embodiment of a column inversion technique which involves using pixels 60 having a two finger electrode configuration to reduce crosstalk in an LCD panel 42. As discussed, inversely driven adjacent pixel electrodes 54 may be susceptible to crosstalk due to the proximity of inversely driven adjacent pixels 60. Pixel electrodes 54 storing a first charge which are proximally closer to pixel electrodes 54 storing an opposite second charge may be more susceptible to such crosstalk. In some embodiments, the pixel matrix 70 and/or the pixels 60 of an LCD 34 may be configured such that adjacent pixel electrodes 54 are proximally farther apart.

For example, as illustrated in FIG. 10, each pixel 60 may have pixel electrodes 54 with only two finger electrodes 84. In some embodiments, each of the two finger electrodes 84 may have a certain width to achieve a desired amount of light transmission within an operating range of the pixel 60. For example, each of the two finger electrodes 84 may be wider than the finger electrodes in typical three-finger electrode configurations, to compensate for having only two (as compared to three) electrode areas through which light is transmitted. Furthermore, each pixel electrode 54 may be spaced farther apart in a horizontal direction (e.g., along the pixel rows) than in typical pixel matrices 70 having three-finger electrode configurations. For example, while pixel matrices 70 having three-finger electrodes may have finger electrodes 84 spaced approximately 4.3 μm apart, pixel matrices 70 having a two-finger electrode configuration may have finger electrodes (e.g., 84*j* and 84*k*) spaced approximately 5 μm apart, as indicated by the separation 96. In some embodiments, the separation 96 may be greater than the liquid crystal cell gap of each pixel electrode 54, thus substantially reducing electrical coupling between two adjacent pixel electrodes 54. Typical reduction in transmittance may be decreased by about 3% with respect to using typical column inversion techniques in three finger electrode configurations. In some embodiments, the total reduction in light transmittance when employing column inversion techniques using the two finger electrode configuration, compared to a typical line inversion technique (without column inversion), may be about 7-9%.

Figure 11:
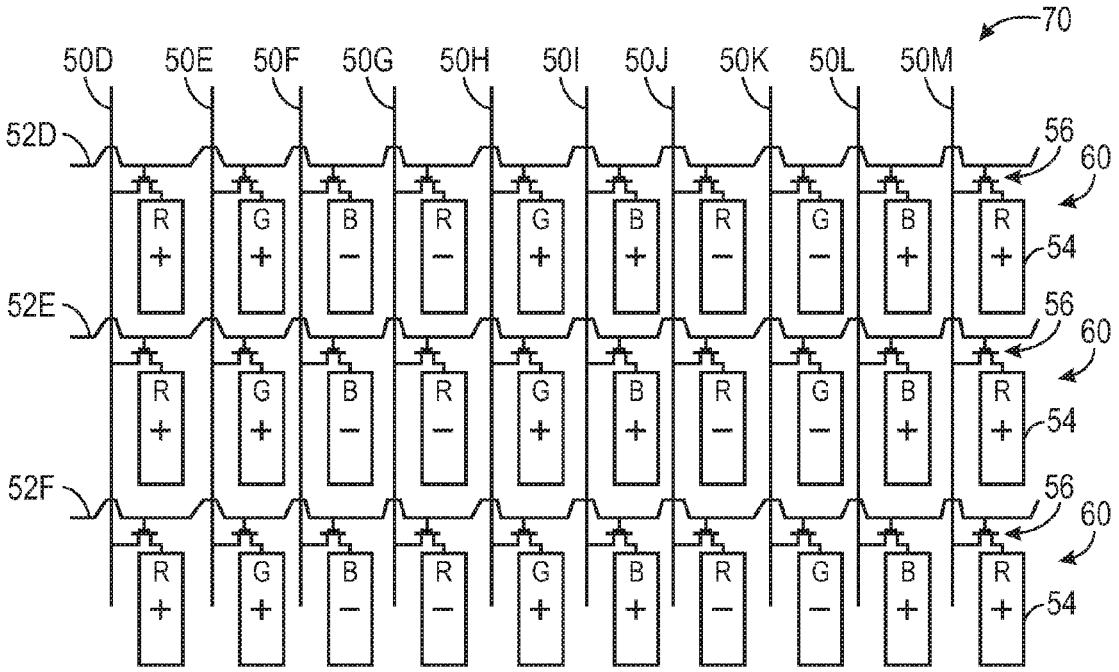
FIG. 11 is a diagram of a 2-column inversion scheme in the LCD of FIG. 4, in accordance with aspects of the present disclosure.

FIG. 11 provides one embodiment of a column inversion technique which reduces crosstalk in a pixel matrix 70, referred to as the 2-column inversion scheme. The 2-column inversion scheme involves switching the polarity of voltage signals driven through data lines 50 for every two pixel columns (i.e., every two data lines 50), instead of switching the voltage signal polarity at every pixel column (i.e., every data line 50, as described in FIG. 6). For example, the 2-column inversion scheme illustrated in FIG. 11 involves driving a first (e.g., positive) voltage signal to two adjacent data lines 50*d* and 50*e* and driving a second voltage signal having an inverse (e.g., negative) polarity to the next two adjacent data lines 50*f* and 50*g*. The pattern of switching the polarity every two columns may continue, and data lines 50*h* and 50*i* may be driven with a voltage signal having a positive polarity.

The 2-column inversion technique decreases the amount of crosstalk in a pixel array 70 between inversely driven pixels 60. Instead of having an inversely driven pixel 60 on each side of a pixel 60 as in typical column inversion techniques, the 2-column inversion technique has an inversely driven pixel 60 only on one side. For example, the right side of the pixels 60 connected to the data line 50*e* may be susceptible to crosstalk from the inversely driven pixels 60 connected to the data line 50*f*. However, the left side of the pixels 60 on the data line 50*e* may not be substantially affected by crosstalk, since the pixels 60 on the data line 50*d* are also driven with a voltage signal having a positive polarity. Therefore, crosstalk effects may be significantly reduced in the 2-column inversion techniques in comparison to column inversion techniques involving switching polarity at every column (data line) of pixels. For example, since crosstalk effects are limited to one side of each pixel 60 instead of two sides of each pixel 60, the typical reduction in transmittance may be decreased by about 50% of light transmission reduction in typical column inversion techniques where polarity is switched at each column of pixels 60. In some embodiments, the total reduction in light transmittance using the 2-column inversion techniques, compared to a typical line inversion technique (without column inversion), may be about 5-10%.

Furthermore, in typical pixel matrix 70 configurations where red, blue, and green pixels (also referred to as subpixels) are driven in columns by data lines (e.g., data lines 50*f*, 50*g*, and 50*h*, respectively), the 2-column inversion technique may be employed such that each data line 50 of red, blue, or green pixels 60 are affected substantially uniformly. For example, in the portion of the pixel matrix 70 illustrated in FIG. 11, the column of red pixels on data line 50*d* may be driven with a voltage signal having a positive polarity, the red pixels on data lines 50*g* and 50*j* may be driven with a voltage signal having a negative polarity, and the red pixels on data line 50*m* may be driven with a voltage signal having a positive polarity. Thus, employing the 2-column inversion technique may also result in driving two adjacent columns of one color at one polarity and the next two adjacent columns of that color at an inverse polarity. As such, crosstalk effects may be reduced similarly for each color, and impact to the image quality may be minimized.

Figure 12:
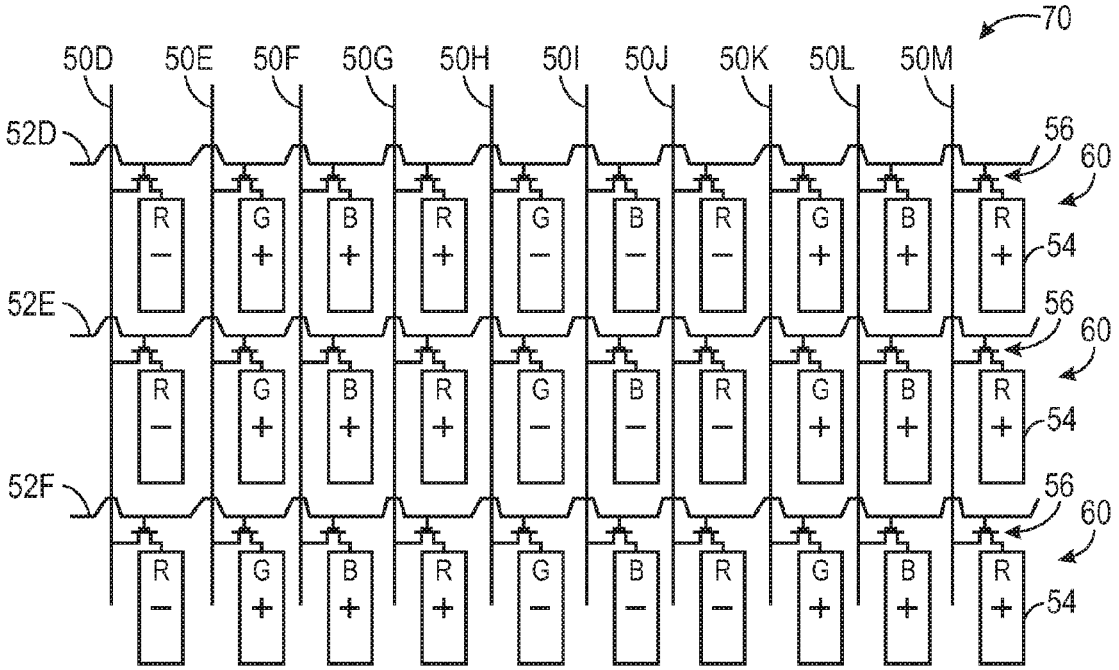
FIG. 12 is a diagram of a multi-column inversion scheme in the LCD of FIG. 4, in accordance with aspects of the present disclosure.

Another embodiment of a column inversion technique which reduces crosstalk, referred to as a multi-column inversion technique, is provided in FIG. 12. The multi-column inversion scheme involves switching the polarity of voltage signals driven through data lines 50 for every three or more pixel columns (i.e., every three or more data lines 50), instead of switching the voltage signal polarity at every pixel column. For example, the multi-column inversion scheme illustrated in FIG. 12 involves driving a first (e.g., positive) voltage signal to three adjacent data lines 50*e*, 50*f*, and 50*g*, and driving a second voltage signal having an inverse (e.g., negative) polarity to the next three adjacent data lines 50*h*, 50*i*, and 50*j*. The pattern of switching the polarity every three columns may continue through the gate line 52 direction of the pixel matrix 70.

The multi-column inversion technique decreases the amount of crosstalk in a pixel array 70 between inversely driven pixels 60. Instead of having an inversely driven pixel 60 on each side of a pixel 60 as in typical column inversion techniques, the multi-column inversion technique has an inversely driven pixel 60 either on only one side, or on no sides, of the pixel 60. For example, in the 3-column inversion technique illustrated in FIG. 12, the left side of the pixels 60 connected to the data line 50*e* may be susceptible to crosstalk from the inversely driven pixels 60 connected to the data line 50*d*. However, the right side of the pixels 60 on the data line 50*e* may not be substantially affected by crosstalk, since the pixels 60 on the data line 50*f* are also driven with a voltage signal having a positive polarity. Similarly, the left side of the pixels 60 on the data line 50*g* may not be affected by crosstalk since the data line 50*f* transmits a voltage signal having a positive polarity, but the right side of the pixels 60 on the data line 50*g* may be susceptible to crosstalk from the inversely driven pixels 60 connected to the data line 50*h*. Moreover, pixels 60 driven by data lines 50 having adjacent pixels 60 driven by voltage signals of the same polarity, such as the pixels 60 on data line 50*f*, may not be substantially affected by crosstalk on any side.

Some embodiments may involve separately controlling and/or adjusting the voltage signals sent to the red, green, and blue pixels 60 for each unit RGB pixel, such that the crosstalk effects are evenly distributed for each color. In the example provided in FIG. 12, the blue pixels 60 on data lines 50*f*, 50*i*, and 50*l* are each adjacent on both sides to pixels 60 driven by voltage signals having the same polarity. As the red and green pixels in this illustration are affected by crosstalk on one side, the blue pixels may have a higher transmittance throughout the LCD panel 42. This may affect the quality of the image displayed from the LCD 34. To compensate for reduced crosstalk effects on certain pixel colors, some embodiments may involve separately controlling the gamma signals and/or reducing or increasing the transmittance of light through data lines 50 connecting certain colored pixels 60.

Crosstalk effects may be significantly reduced in the multi-column inversion techniques in comparison to column inversion techniques involving switching polarity at every column (data line) of pixels. In some embodiments, multi-column inversion techniques may switch polarities at every 4, 5, or more columns, such that for every 2 pixel columns affected by crosstalk on one side, 2, 3, or more pixel columns may not be substantially affected by crosstalk. However, as more data lines 50 are grouped to be switched at common polarities, the perceptibility of the switching may increase, as the common polarity switch occurs over a larger area of the LCD panel 42. Perceptible switching at common polarities may manifest as undesirable display artifacts, such as flickering. Thus, one or more embodiments may involve column inversion techniques which optimize various advantageous display characteristics. For example, a certain technique and/or number of columns in multi-column inversion may be selected to achieve certain thresholds of reduced power, increased transmittance, and reduced display artifacts.

Figure 13:
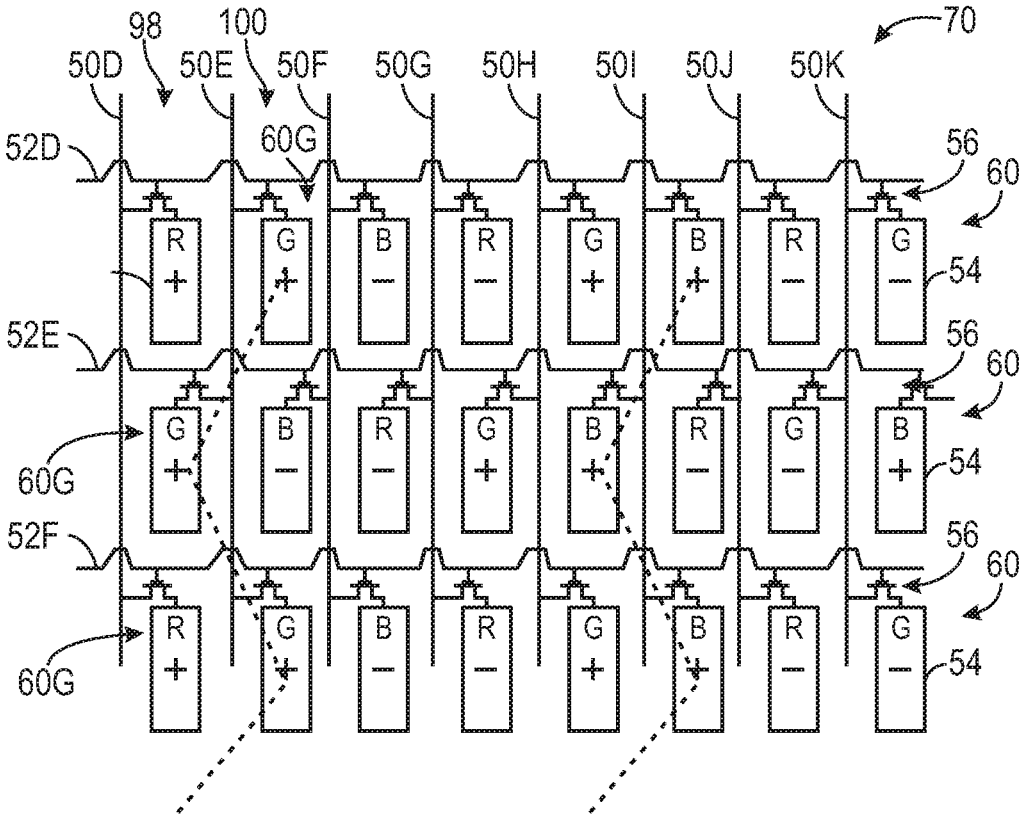
FIG. 13 is a diagram of a 2-column Z inversion scheme in the LCD of FIG. 4, in accordance with aspects of the present disclosure.

Another embodiment of a column inversion technique which reduces crosstalk, referred to as a 2-column Z inversion technique, is provided in FIG. 13. The 2-column Z inversion technique involves a pixel matrix 70 configuration where one data line 50 connects to pixels 60 of the same color. Similar to the 2-column inversion technique discussed with respect to FIG. 11, the 2-column Z inversion technique also involves switching the polarity of voltage signals driven through data lines 50 for every two data lines 50, instead of switching the voltage signal polarity at every data line 50. Furthermore, a polarity switch may occur every two pixels 60 on a gate line 52, thus limiting crosstalk to one side of each pixel 60. However, in the 2-column Z inversion technique, the positions of the pixels 60 in one data line 50 may follow a "Z" pattern in the pixel matrix 70. As indicated by the dotted lines in FIG. 13, the electrode 54 of a green pixel 60*g* on gate line 52*d* may be connected to the right side of a data line 50*e* at the source 58 of the TFT 56 and a green pixel 60*g* on gate line 52*e* may be connected to the left side of the data line 50*e* at the source 58 of the TFT 56. The Z pattern may continue through the data line 50*e*, as the green pixels 60*g* are alternatingly connected on either side of the data line 50*e*, which results in the data line 50*e* connecting in an alternating pattern (i.e., the Z pattern) between two adjacent pixel columns 98 and 100. This Z pattern may also be consistent for other colors, as indicated by the second dotted line on the blue pixels 60 connected to data line 50*i*. By employing 2-column inversion on a pixel matrix 70 configured in a Z pattern, the pixel columns may have alternating columns of pixels 60 driven with one common polarity (e.g., pixel column 98) and columns of pixels 60 driven with alternating inverse polarities (e.g., pixel column 100).

Employing 2-column inversion techniques in a pixel matrix 70 having a Z pattern configuration may reduce crosstalk to a similar extent as the 2-column inversion techniques discussed in FIG. 11, and may also reduce display artifacts such as flickering in comparison to the 2-column inversion techniques. As discussed, polarity switching may be increasingly perceptible as more data lines 50 are grouped for switching at common polarities. Thus, 2-column inversion techniques may result in more flickering (though less crosstalk) than single column inversion techniques. However, using a Z pattern in the pixel matrix 70 may decrease the perceptibility of polarity switching compared to the 2-column inversion techniques described in FIG. 11, as the pixel matrix 70 includes pixel columns 98 of pixels 60 driven with a uniform polarity which alternate with pixel columns 100 of pixels 60 driven with alternating inverse polarities.

In various embodiments, the multi-column inversion techniques described with respect to FIG. 12 may also be combined with the Z-pattern concept of FIG. 13. For example, three or more adjacent data lines 50 may be driven with voltage signals having a common polarity, and the polarity may be switched every three data lines 50. Moreover, in some embodiments, any of the different data line 50 driving techniques may be combined with the two finger electrode configuration discussed with respect to FIG. 10. In different embodiments, any the column inversion techniques discussed with respect to FIGS. 10-13 may be combined. As discussed, different techniques or combinations may be employed based on the configuration of the LCD 34 and/or to optimize various desired characteristics (e.g., low operating power, high light transmission, low perceptibility of visual artifacts, etc.).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A liquid crystal display (LCD) comprising:

a plurality of data line groups, each data line group comprising three or more directly adjacent data lines, wherein each data line is connected to a plurality of pixels of a same color and configured to transmit a voltage signal to the connected plurality of pixels, and wherein the connected plurality of pixels are connected to a left side and a fight side of the data line in an alternating manner; and one or more data line drivers configured to drive voltage signals to each data line group, wherein the voltage signal transmitted to each data line group comprises a polarity that is opposite from a polarity of a voltage signal transmitted to any adjacent group of data lines during one time period, wherein the polarity of the voltage signal transmitted to each data line group alternates between opposite polarities throughout an operation of the LCD, and wherein the one or more data line drivers is configured to modify the voltage signal driven to an inner data line of the three or more adjacent data lines without modifying the voltage signal driven to outer data lines of the three or more adjacent data lines based on reduced crosstalk effects on the plurality of pixels connected to the inner data line compared to the plurality of pixels connected to the outer data lines of the three or more adjacent data lines.

2. The LCD of claim 1, comprising a plurality of pixel rows overlapping and intersecting with a plurality of pixel columns, wherein each of the plurality of pixel rows comprises a color pixel pattern comprising alternating color pixels, wherein each of the plurality of pixel rows has a color pixel pattern which is shifted by one color pixel with respect to an adjacent pixel row.

3. The LCD of claim 1, wherein each of the plurality of pixels comprises a pixel electrode comprising three or more finger electrodes.

4. The LCD of claim 1, wherein each of the plurality of pixels comprises a pixel electrode comprising only two finger electrodes.

5. The LCD of claim 1, wherein the one or more data line drivers is configured to modify the voltage signal driven to an inner data line of the three or more adjacent data lines to:

separately control gamma signals provided to the plurality of pixels connected to the inner data line; or reduce light transmittance of the plurality of pixels connected to the inner data line of the three or more adjacent data lines.

6. The LCD of claim 1, wherein some of the plurality of pixels are driven by a voltage signal having an opposite polarity to a voltage signal driving an adjacent pixel on only one side along a pixel row direction, and others of the plurality of pixels are driven by a voltage signal having a common polarity with the adjacent pixels on both sides along the pixel row direction.

7. A liquid crystal display (LCD) layer, comprising:

a plurality of pixel columns each comprising a plurality of pixels, wherein the plurality of pixel columns comprises a first column, a second column, a third column, and a fourth column, wherein the second column is adjacent to and between the first column and the third column and the third column is adjacent to and between the second column and the fourth column;

a first data line connected to the first column and the second column in an alternating pattern between the first column and the second column, wherein the first data line is only connected to pixels of a first color;

a second data line connected to the second column and the third column in an alternating pattern between the second column and the third column, wherein the second data line is only connected to pixels of a second color;

a third data line connected to the third column and the fourth column in an alternating pattern between the third column and the fourth column, wherein the third data line is only connected to pixels of a third color;

wherein the second data line is directly adjacent to both the first data line and the third data line; and a data line driver configured to:

drive a signal having a first polarity through each of the first, the second, and the third data lines, wherein only the signal driven to the second data line is modified to compensate for reduced crosstalk effect on the plurality of pixels connected to the second data line; and drive the signal having a second polarity through each of the first, the second, and the third data lines, wherein the first polarity is opposite from the second polarity and only the signal driven to the second data line is modified to compensate for reduced crosstalk effect on the plurality of pixels connected to the second data line.

8. The LCD layer of claim 7, wherein the first column comprises green pixels and blue pixels, the second column comprises blue pixels and red pixels, the third column comprises red pixels and green pixels, and the fourth column comprises green pixels and blue pixels.

9. The LCD layer of claim 8, wherein the first data line is connected to each of the blue pixels in the first column and each of the blue pixels in the second column, the second data line is connected to each of the red pixels in the second column and each of the red pixels in the third column, and the third data line is connected to each of the green pixels in the third column and each of the green pixels in the fourth column.

10. The LCD layer of claim 8, wherein the data line driver is configured to drive the first data line, the third data line, and the second data line with a signal alternating between the first polarity and the second polarity throughout an operation of the LCD layer.

11. A method of minimizing crosstalk while employing column inversion in a liquid crystal display (LCD), the method comprising:

configuring a pixel matrix into a plurality of groups of data lines, wherein each group of data lines comprises three or more adjacent data lines, and wherein each data line is connected to a plurality of pixels;

transmitting an image signal driven to each group of data lines, wherein the image signal transmitted to each group of data lines comprises an inverse polarity to the image signal transmitted to any adjacent groups of data lines; and modifying only image signals driven to outer data lines of the three or more adjacent data lines to compensate for increased crosstalk effects on the plurality of pixels connected to the outer data lines as compared to the plurality of pixels connected to an inner data line of the three or more adjacent data lines.

12. The method of claim 11, wherein each data line is configured to connect in an alternating pattern between pixels of two adjacent pixel columns of the LCD.

13. The method of claim 11, comprising configuring each of the plurality of pixels to have a pixel electrode comprising only two finger electrodes.

14. The method of claim 11, wherein modifying only image signals driven to the outer data lines comprises increasing light transmittance of the plurality of pixels connected to the outer data lines.

15. A liquid crystal display (LCD) comprising:

a plurality of data line groups, each data line group comprising three or more adjacent data lines, wherein each data line is connected to a plurality of pixels and configured to transmit a voltage signal to the connected plurality of pixels; and one or more data line drivers configured to drive voltage signals to each data line group, wherein the voltage signal transmitted to each data line group comprises a polarity that is opposite from a polarity of a voltage signal transmitted to any adjacent group of data lines, wherein the one or more data line drivers is configured to:

drive a compensated voltage signal to an inner data line of the three or more adjacent data lines; and drive uncompensated voltage signals to outer data lines of the three or more adjacent data lines such that reduced crosstalk effects on the plurality of pixels connected to the inner data line compared to the plurality of pixels connected to outer data lines of the three or more adjacent data lines are compensated.

16. The LCD of claim 15, wherein each data line is configured to connect in an alternative pattern between pixels of two adjacent pixel columns of the LCD.

17. The LCD of claim 15, wherein each data line is connected to a plurality of pixels of a same color.

18. The LCD of claim 15, wherein each of the plurality of pixels comprises a pixel electrode comprising only two finger electrodes.

19. The LCD of claim 15, wherein each of the plurality of pixels comprises a pixel electrode comprising three or more finger electrodes.

20. The LCD of claim 15, wherein each of the plurality of pixels comprises a pixel electrode configured to have a distance from a pixel electrode of an adjacent pixel in a pixel row direction, wherein the distance is larger than a liquid crystal cell gap.

* * * * *

UNITED STATES PATENT AND TRADEMARK OFFICE

CERTIFICATE OF CORRECTION

PATENT NO. : 8,988,334 B2
APPLICATION NO. : 12/941751
DATED : March 24, 2015
INVENTOR(S) : Ge et al.

It is certified that error appears in the above-identified patent and that said Letters Patent is hereby corrected as shown below:

In the Claims

In Column 12, line 45 (Claim 1), replace “fight” with --right--.

Signed and Sealed this
Eighth Day of September, 2015

Michelle K. Lee

Michelle K. Lee
*Director of the United States Patent and Trademark Office*